United States Patent [19]

Kobayashi et al.

[11] Patent Number: 4,747,233

[45] Date of Patent: May 31, 1988

[54] DRIVING APPARATUS FOR WORK HOLDING SHAFTS IN GYROFINISHING MACHINE

[75] Inventors: Hisamine Kobayashi; Toshiharu Shimizu, both of Nagoya, Japan

[73] Assignee: Tipton Manufacturing Corporation, Nagoya, Japan

[21] Appl. No.: 908,503

[22] Filed: Sep. 17, 1986

[51] Int. Cl.[4] ..... B24B 31/00

[52] U.S. Cl. ..... 51/7

[58] Field of Search ..... 51/163.1, 7; 74/46, 74/49, 89.17, 109

[56] References Cited

U.S. PATENT DOCUMENTS 2,958,263 11/1960 Palkowski ..... 74/89.17

3,166,270 1/1965 DeJong ..... 74/89.17

3,494,205 2/1970 Heese ..... 74/89.17

3,623,278 11/1971 Schwartz ..... 51/7

4,240,229 12/1980 Ohno ..... 51/7

*Primary Examiner*—Harold D. Whitehead

*Attorney, Agent, or Firm*—Wenderoth, Lind & Ponack

[57] ABSTRACT

In a gyrofinishing machine, each of the gyratory shafts for holding individual works is controlled by the combination of rack and pinion and the crank mechanism for driving the rack and pinion combination so that the particular part of a work held by the corresponding gyratory shaft can be exposed for the longer time to the abrasive media used for finishing the work, and the gyratory shaft can be stopped at the particular position with high accuracy.

3 Claims, 6 Drawing Sheets

DRIVING APPARATUS FOR WORK HOLDING SHAFTS IN GYROFINISHING MACHINE

BACKGROUND OF THE INVENTION

1. Field of the Invention

The present invention relates generally to a work finishing machine, and more particularly to a machine of the type that includes gyratory shafts for holding individual workpieces for the purpose of polishing the surfaces and edges of the workpieces together with their abrasive media within the individual containers. More specifically, it relates to an improvement in the construction of the gyratory shafts for holding workpieces for use in the machine of the above type.

2. Description of the Prior Art

A conventional prior art machine of the class disclosed herein, such as U.S. Pat. No. 4,373,296, includes individual gyratory shafts for holding individual workpieces, and the axial rotation of those gyratory shafts is caused by means of the combination of a drive motor and a power transmission system. The gyratory shafts have one-way rotation and a fixed constant speed.

The drive motor and power transmission combination includes no control means that causes a change in the speed of rotation during one complete revolution of the gyratory shafts. The reversal of the direction of rotation for the gyratory shafts must be accomplished by varying the direction of rotation for the drive motor. In this way, it is very difficult to obtain the reversal of the shafts at very short intervals. Furthermore, when a given gyratory shaft is to be stopped in position for attaching a workpieces thereto, a device is provided for controlling the position in which the given gyratory shaft is to be stopped. In this case, it is necessary to determine the relative position between the work tightening device and the work charging device so that their positions can match each other.

SUMMARY OF THE INVENTION

In order to solve the above-described problems, one principal object of the present invention is to provide an improved gyratory shaft construction including a pinion affixed to the shaft and a rack meshing with the pinion for causing the shaft to rotate through the pinion. Reciprocating movement of the rack is provided by a crank mechanism or fluid-operated cylinder. Thus, the gyratory shaft can be reversed alternately for each complete revolution. In this manner, it is possible to obtain a workpiece that presents no irregularly finished surface, which would otherwise be caused by any difference in the amount to be finished for the particular shapes of the work. In order to make this possible, that portion of the work which needs most to be finished is placed at the location where the gyratory shaft rotates the most slowly so that the portion can be exposed to the most part of the abrasive media flowing around in the container for the greatest period of time. In other words, the present invention is based upon the concept that the gyratory shaft can rotate with a speed that may vary depending upon the requirements of any particular portion of the work that needs the finishing. Thus, that portion of the workpiece can be exposed to the abrasive media for the longest time by slowing the rotation of the gyratory shaft. By doing so, the overall finishing performance or efficiency can be improved. Furthermore, the mechanism for causing the reciprocating movement of the gyratory shaft may also be used as means to position the shaft in the appropriate stop location. In this case, the location where the shaft is to be stopped may correspond to the start and end points of the reciprocating mechanism. Thus, when the gyratory shaft is rotating the most slowly, it can be stopped in its accurate position, regardless of any positioning error that may be caused by the reciprocating mechanism. Thus, high positioning accuracy can be obtained.

Specifically, the work holder construction provided by the present invention includes a housing that is capable of travelling up and down and within which a shaft for holding a work is journalled. Each of such housings also contains a rack which meshes with a pinion affixed to the work holding shaft. The rack and pinion combination permits the shaft to rotate alternately in one and opposite directions at very short intervals. Therefore, the position in which the work is to be finished can be controlled by making the corresponding housing travel up or down.

BRIEF DESCRIPTION OF THE DRAWINGS

The above and other objects, advantages, and merits of the present invention will readily be understood by reading the detailed description of the preferred embodiments of the present invention that follows with reference to the accompanying drawings, in which.

DETAILED DESCRIPTION OF THE PREFERRED EMBODIMENTS

Figure 1:
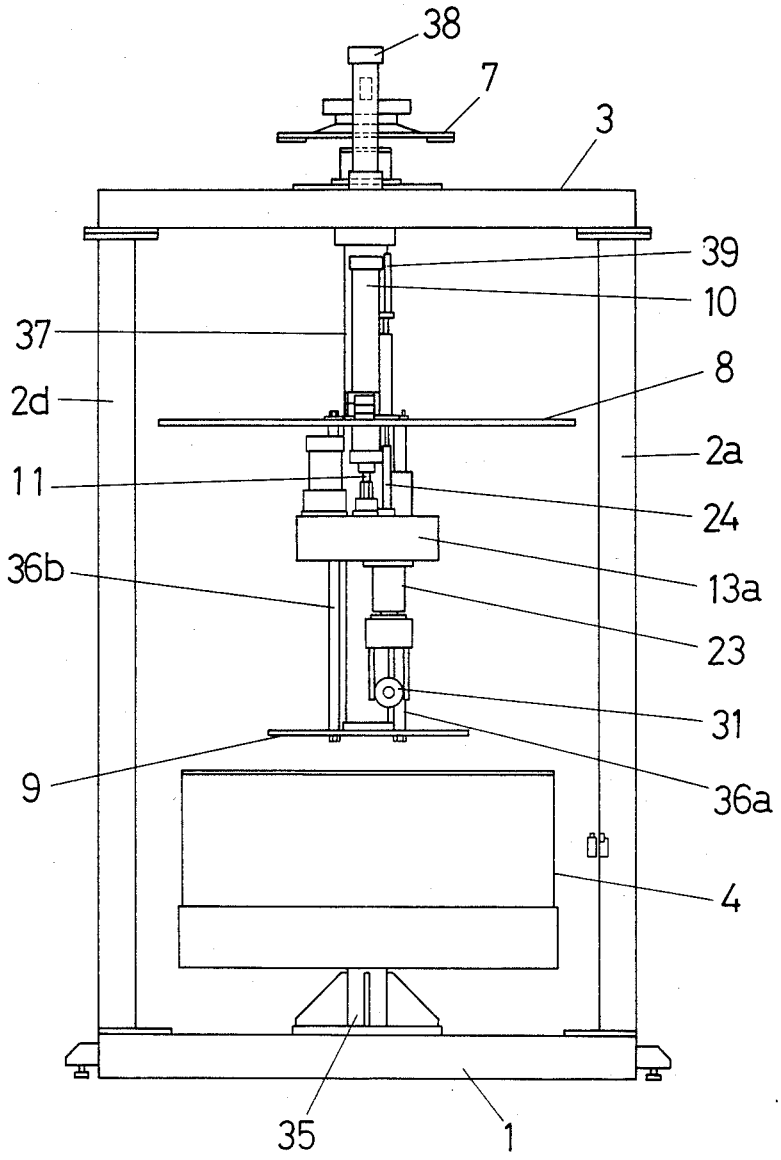
FIG. 1 is a general side elevation of a gyrofinishing machine that incorporates the work holding shaft construction provided by the invention.
Figure 2:
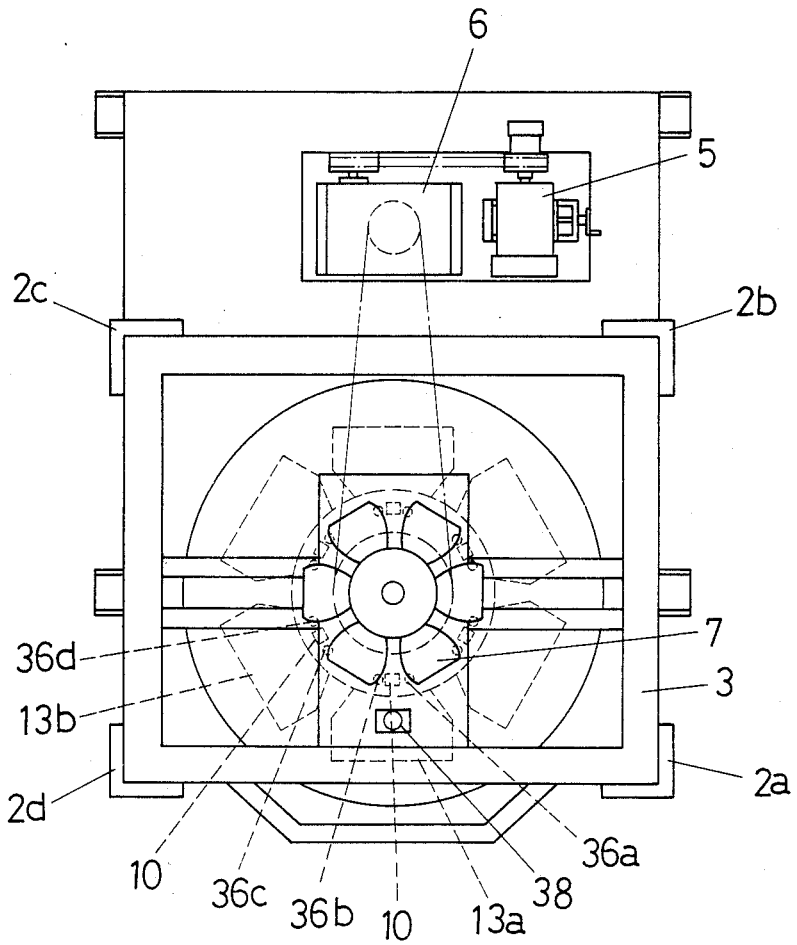
FIG. 2 is a plan view of the same as shown in FIG. 1.

FIGS. 1 and 2 illustrate the apparatus of the present invention incorporated in atypical gyrofinishing machine. For simplicity and easy understanding of the machine construction, one of the several units which are to be included in the machine construction is shown in FIG. 1, and will be described.

Figure 3:
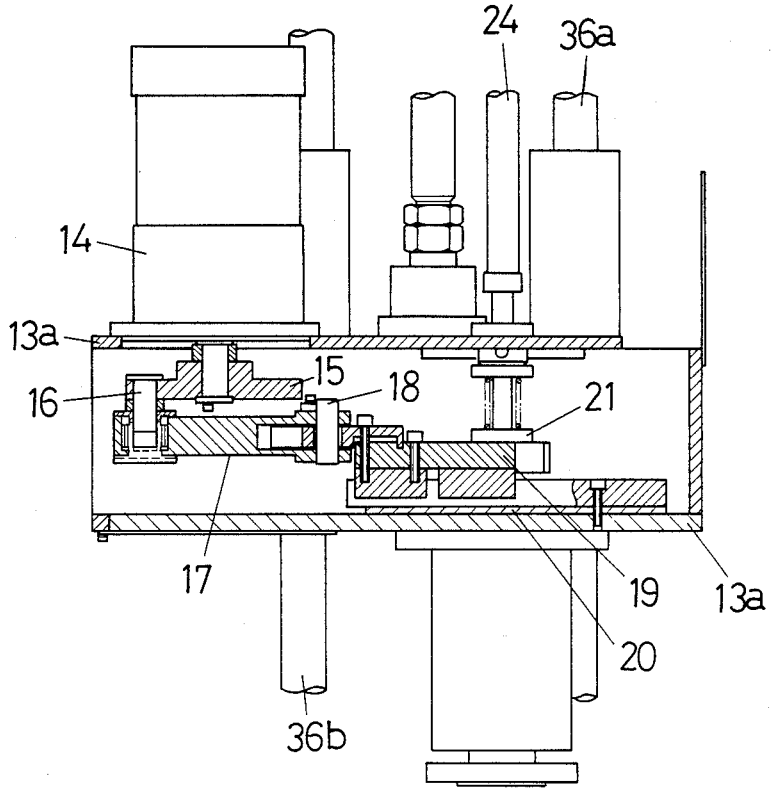
FIG. 3 is a front elevation view of the preferred embodiment of the work holding shaft construction according to the present invetion.
Figure 4:
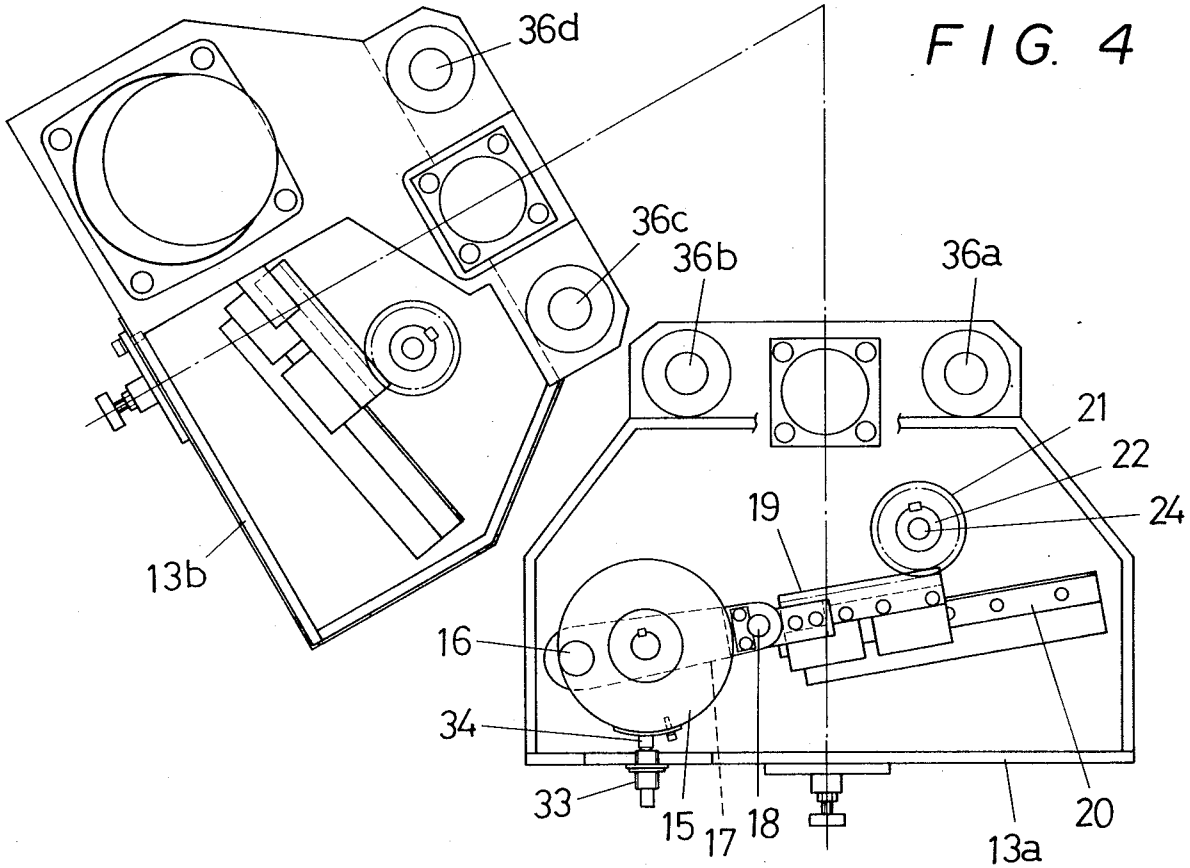
FIG. 4 is a plan view of the same as shown in FIG. 3.
Figure 5:
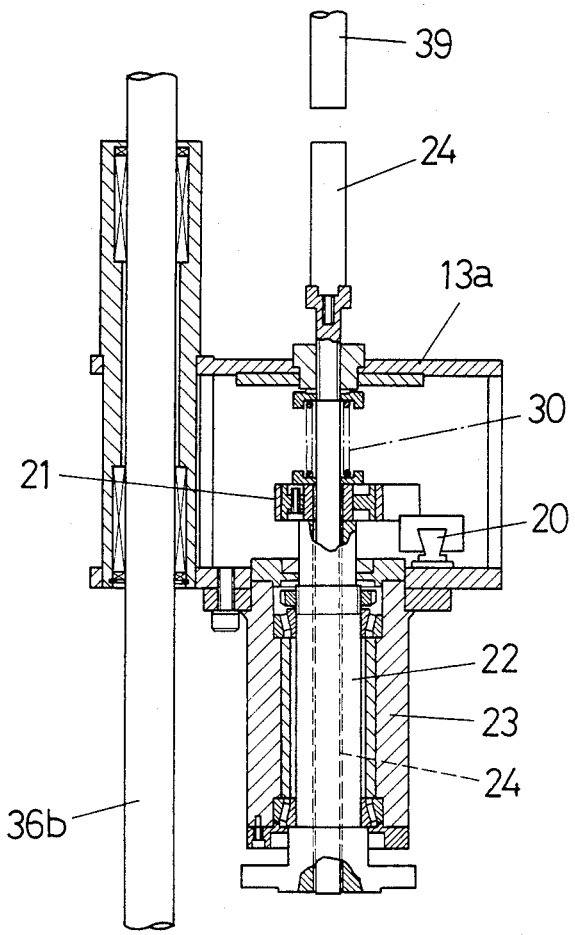
FIG. 5 is a side elevation of the same as shown in FIG. 3.

Generally, the machine construction includes a machine base 1, on which usually four side posts *2a, 2b, 2c,* and *2d* are secured at the four corners, extending upwardly. At the tops of the posts, a top frame 3 is disposed and rigidly secured to those posts. The top frame 3 carries a bearing, in which a central spindle 37 for causing a gyratory motion is journalled. A work finishing unit which is usually provided in the form of a work finishing container 4 is disposed on the machine base 1, and is rotatably supported by a rotary shaft 35 which is journalled on the machine base 1. The rotary shaft 35 is driven for rotation by means of its driving motor 5 and reduction gears 6. Rotating the shaft 35 causes the work finishing container 4 to rotate. The central spindle 37 is connected to Geneva gears 7 which drive the central spindle for stepwise rotation. The central spindle 37 carries an upper rotary disc plate 8 and a lower rotary disc plate 9 which are spaced away from each other in the axial direction of the spindle. The central spindle 37 is also provided with a plurality of pairs of guides 36*a*, 36*b*, 36*c*, 36*d* (six pairs are provided for the example shown in FIG. 2) extending longitudinally between the upper and lower rotary disc plates 8 and 9. Those guides are secured to the lower disc plate 9. The upper rotary disc plate 8 has fluid-operated cylinders 10 extending upwardly from its upper surface, each of the fluid-operated cylinders 10 controlling the up and down movement of the corresponding shaft which holds a workpiece. The fluid-operated cylinder 10 has a piston rod whose forward end 11 is affixed to the corresponding housing 13*a*, 13*b*, etc. (in the example of FIG. 2, six housings are shown) in which a gyratory shaft is accommodated. Details of the gyratory shaft are illustrated in FIGS. 3, 4 and 5. This gyratory shaft constitutes the subject matter of the present invention.

Figure 6:
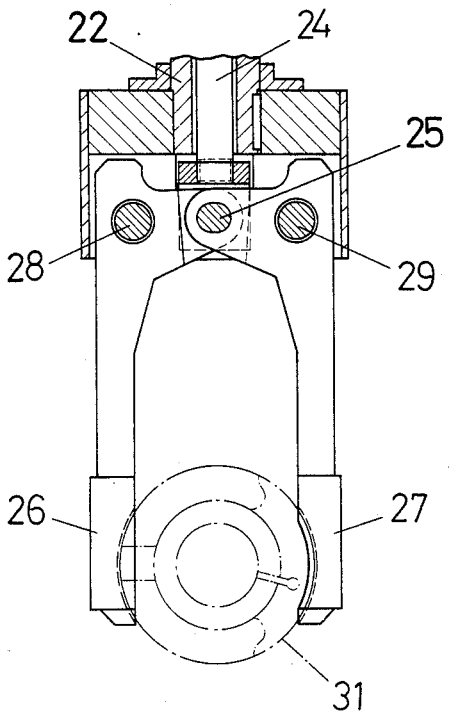
FIG. 6 is a front elevation view of the work holding apparatus.
Figure 7:
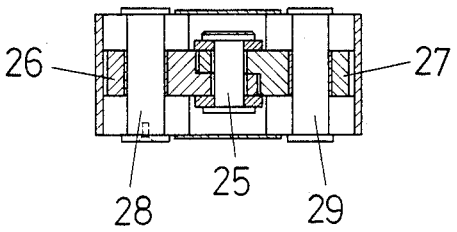
FIG. 7 is a partial sectional view of the same as shown in FIG. 6.

The gyratory shaft housings 13*a*, 13*b*, etc. are secured to the corresponding forward ends 11 of the piston rods, as described above, and are capable of sliding movement between and along the pair of guides 36*a* and 36*b*, for example. Each housing 13*a*, 13*b*, etc. is connected to a drive motor 14 which drives the gyratory shaft in the housing. The motor 14 has a drive shaft having a drive wheel 15 at one end. The drive wheel 15 has a pin 16 extending longitudinally through the peripheral wall on one side thereof. The pin 16 supports a crank arm 17 having one end thereof engaging the pin 16 so that the crank arm 17 can rotate. The crank arm 17 is supported at the other end by a pin 18, to which a rack rod 19 carrying teeth thereon is mounted. The rack rod 19 is equipped at one end thereof with a hole which engages the above-mentioned pin 18. The rack rod 19 is thus supported rotatably about the pin 18 and is also in the sliding relationship to a rackslide 20 rigidly mounted within the housing 13*a*, for example. The teeth on the rack rod 19 meshes with a pinion 21, which is mounted to the gyratory shaft 22. As shown in FIG. 5, the gyratory shaft 22 is rotatably journalled in a bearing 23 fixed to its housing 13*a*. The gyratory shaft 22 is hollow, allowing a work holder shaft 24 to pass through the hollow shaft 22. The work holder shaft 24 is secured at its bottom end to a pin 25, as shown in FIG. 6. A bell crank includes work holding arms 26 and 27, each of which is rotatably supported on a pin 28 or 29, respectively. The bell crank has an elongated aperture on the side where the two arms 26 and 27 are connected. The elongated aperture engages the pin 25 so that the arms 26 and 27 can turn about their respective pins 28 and 29 when the work holder shaft 24 moves up or down. Thus, the arms open or close so that a work 31 can be held or released. Above the work holder shaft 24, there is disposed a fluid-operated cylinder 38 (shown in FIG. 1) and a pushing rod 39 in a spaced relationship to the work holder shaft 24. The pushing rod 39 is loaded with a spring 30, and when the pushing rod 39 is moved down by the cylinder 38, the spring 30 is compressed. Then, the work holder shaft 24 is moving down under the action of the compressed spring, opening the bell crank arms 26 and 27. Thus, the work held by the arms is released. When the piston of the cylinder is withdrawn, the biasing action of the spring 30 restores the pushing rod 39 to its raised position, followed by raising the work holder shaft 24. Then, the bell crank arms 26 and 27 are closed, and a work is held by the arms.

The operation is now described in accordance with the construction of the apparatus described above.

At the start of the operation, it is assumed that a container 4 contains an appropriate quantity of abrasive media, which is usually in particulate form, as well as any required water and other compounds. Then, the motor 5 for causing the rotation of container 4 is started. The bell crank arms 26 and 27 assume the position in which a work 31 is held, and as the work 31 is held by the arms, it is placed into the container 4 or the abrasive media therein. Thus, the workpiece 31 is subjected to the abrading action provided by the abrasive media. As described earlier, the apparatus according to the present invention provides the dual functions, one of which is to cause the rotation of the work holder within the container, and the other of which is to position the workpiece holder when a work is to be held or released. All the operations that occur, starting with an initial step of holding a work by means of the bell crank arms 26 and 27 and ending with a final step of releasing the same work from the arms at the end of one cycle of the finishing operation may be controlled by an automatic sequence controller. Part of those operations may also be manual.

At the end of one cycle of the finishing operation, the gyratory shaft 22 is stopped at the position where the work is to be released, and then it is lowered by actuating the fluid-operated cylinder 38 above the work holder shaft 24. This is followed by lowering the pin 25 shown in FIG. 6, which opens the bell crank arms 26 and 27 apart from each other. Thus, the work 31 is released from the bell crank arms. This work is handled by a separate device (not shown), which moves it away from the machine for any further processing.

Following the above sequence of operation, a separate transporter (which is also not shown) for handling a work to be finished carries a new workpiece to the position where the bell crank arms from which the finished work has just been released as described above is located. When the work is placed between the bell crank arms 26 and 27, the fluid-operated cylinder 38 above the pin 25 is then actuated to have its piston withdrawn. The biasing action of the compressive spring 30 restores the work holder shaft 24 to its raised position, followed by closing the bell crank arms 26 and 27. Thus, the workpiece is held. Following this, the work held by the arms is placed into the container 4.

Then, the motor 14 for driving the gyratory shaft for rotation is started, driving the drive wheel 15 and then the crank arm 17. The crank arm 17 then causes the rack 19 to reciprocate forth and back, which causes the pinion 21 engaging the rack to rotate alternately in one or opposite directions on its axis. This is followed by rotating the gyratory shaft 22 affixed to the pinion and therefore the work 31 accordingly.

For the example described above, it is assumed that a workpiece has a flat shape, for example, as shown in FIG. 6. In this assumption, the direction in which the abrasive media is flowing perpendicular to the plane of the drawing (FIG. 6) may correspond to the dead center of the crank arm (the position of the crank arm as shown in FIG. 4). For the usual operation of the crank mechanism, it is known that when the crank arm is placed at or near its dead center, the part which is operatively associated with the crank arm provides the slowest motion. For the rack as in this example, its sliding motion is the slowest at or near the dead center. Thus, the speed with which the workpiece held by its holder shaft associated with the rack motion is rotated is the slowest. While the work is then rotating the most slowly, it can be exposed, for the longer time, to the abrasive media flowing perpendicular to the plane of the workpiece. Thus, improved work finishing efficiency results.

When the particular gyratory shaft 22 is to be stopped at the location where the workpiece is to be replaced, at the end of the particular operation time, the timing at which the shaft is to be stopped is determined by a micro switch 33 on the side of the gyratory shaft housing 13*a* that responds to a dog 34 on the side of the drive wheel 15, as shown in FIG. 4. In this case, as shown in FIG. 4, the stop position may also correspond to the dead center of the crank arm. At the dead center, a "STOP" command may be issued when the drive wheel 15 is rotating the most slowly. In response to this "STOP" command, the drive wheel 15 can be stopped with high accuracy. The position of the bell crank arms 26 and 27 to be stopped will not be affected by any slight errors in positioning the drive wheel 15 to its stop. Thus, higher accuracy can also be obtained in this respect.

In the preceding embodiment, the crank mechanism is employed to cause the rack to reciprocate forth and back. The reciprocating movement of the rack may be provided by any other means, such as a fluid-operated cylinder. Therefore, the present invention is not limited to the specific embodiment described herein. Essentially, any other means that permits the rack to reciprocate may fall within the scope of the present invention.

As is has been fully described, the work holder shaft driving apparatus according to the present invention provides two principal advantages over the corresponding prior art construction. The apparatus of the present invention may be used in conjunction with the gyratory shaft for the gyration-type machine.

First, the start and end points (dead center) of the crank motion may be set to correspond to the orientation of a particular work in which such oriented surface of the workpiece needs most to be finished. As the rotational speed of the gyratory shaft is the slowest at those points, the oriented surface of the work can be exposed to the abrasive media flow for the longer time. Thus, the portion of the workpieces that has heretofor been difficult to finish can have more opportunities to be processed.

Second, the start and end points (dead center) of the crank motion may also be set to correspond to the position in which the gyratory shaft is to be stopped for the purpose of replacing workpieces. For similar reasons, the highest positioning accuracy can be obtained.

Although the present invention has been described with reference to the specific preferred embodiment thereof, it should be understood that various changes and modifications may be made without departing from the scope and spirit of the invention.

What is claimed is:

1. In a gyrofinishing machine including gyratory shafts for holding individual workpieces, containers for containing flowing abrasive media for subjecting the surfaces of the workpieces to the abrading action of the abrasive media flowing within the containers, and a driving apparatus for the gyratory shafts, the improvement comprising said driving apparatus having a housing for each of the gyratory shafts, each said housing being vertically adjustable, each said gyratory shaft being journaled within the corresponding housing; and means for driving each said gyratory shaft for rotation and accomodated within the corresponding housing, said driving means including a pinion secured to each said gyratory shaft, a rack meshing with said pinion, and means for causing the reciprocating motion of said rack for reciprocating each said driven gyratory shaft.

2. A driving apparatus as defined in claim 1, wherein said means for causing the reciprocating motion of said rack for reciprocating each said driven gyratory shaft includes a driving motor within said housing, a wheel driven by said motor for rotation, and a crank arm having one end thereof rotatably connected to a peripheral point of said driven wheel offset from the center of said driven wheel and having the other end thereof rotatably connected to said rack.

3. A driving apparatus as defined in claim 1, wherein said means for causing the reciprocating motion of said rack for reciprocating each said driven gyratory shaft comprises a fluid-operated cylinder disposed between said rack and said housing.

* * * * *